United States Patent [19]

Nishimori et al.

[11] Patent Number: 4,644,115

[45] Date of Patent: Feb. 17, 1987

[54] COMPACT SNAP ACTION SWITCH

[75] Inventors: Shoji Nishimori, Mie; Takeshi Nishii, Matsusaka, both of Japan

[73] Assignee: Matsushita Electric Works, Ltd., Japan

[21] Appl. No.: 759,290

[22] Filed: Jul. 26, 1985

[30] Foreign Application Priority Data

Aug. 24, 1984 [JP] Japan ..... 59-176931

[51] Int. Cl.[4] ..... H01H 5/20

[52] U.S. Cl. ..... 200/67 D; 200/267; 200/284

[58] Field of Search ..... 200/267, 67 D, 284, 200/67 DA

[56] References Cited

U.S. PATENT DOCUMENTS

| | | | |
|---|---|---|---|
| 2,549,998 | 4/1951 | Allison | 200/284 |
| 2,818,734 | 1/1958 | Howe | 200/67 D |
| 3,189,703 | 6/1965 | Chapin et al. | 200/67 D |
| 3,476,898 | 11/1969 | Ehrenfels et al. | 200/67 D |
| 3,548,131 | 12/1970 | Piber | 200/67 D |
| 4,005,299 | 1/1977 | Keough | 200/267 X |
| 4,032,734 | 6/1977 | Burch | 200/67 DA |
| 4,523,064 | 6/1985 | Rose | 200/67 D |

FOREIGN PATENT DOCUMENTS

| | | | |
|---|---|---|---|
| 2918812 | 11/1980 | Fed. Rep. of Germany DA | 200/67 |
| 52-6464 | 2/1977 | Japan | 200/267 |
| 56-43571 | 10/1981 | Japan . | |
| 2092383 | 8/1982 | United Kingdom | 200/267 |

*Primary Examiner*—Stephen Marcus
*Assistant Examiner*—Renee S. Luebke
*Attorney, Agent, or Firm*—Poms, Smith, Lande & Rose

[57] ABSTRACT

A miniature snap action switch comprises a movable spring sheet which is pivotally supported to a common contact member for movement with a snap action into and out of contact with a cooperative fixed contact. The movable spring sheet is plated with a precious metal such as silver, gold, or an alloy of each at a portion to be pivoted to the common contact member as well as at a portion for contact with the fixed contact for improving electrical conductivity at the respective interfaces and at the same time defining on the movable spring sheet a movable contact of extremely reduced thickness. Accordingly, the movable spring sheet can be dispensed with a conventional contact tip of rather bulky configuration to thereby enable the entire contact assembly to be made in a greatly reduced dimensions particularly in the direction of the thickness of the movable spring sheet, resulting a very compact arrangement of the miniature switch.

2 Claims, 4 Drawing Figures

COMPACT SNAP ACTION SWITCH

BACKGROUND OF THE INVENTION

1. Field of the Invention

The present invention is directed to a miniature switch, and more particularly to an improved miniature snap action switch of compact size and extended operating life.

2. Description of the Prior Art

In the miniature switches which have been widely provided, it is customary to utilize a snap action spring with movable contacts for movement into and out of contact with cooperative fixed contacts, as exemplarily shown in FIG. 4. The miniature switch of this type comprises a base 1 mounting thereon a common contact member 2, separate contact carriers 3 and 4, and a snap action spring 5 with movable contact tips 6 and 7. The snap action spring 5 is pivotally supported to the common contact member 2 so that the free end portion carrying said movable contact tips 6 and 7 is movable with a snap action between a pair of vertically spaced fixed contacts 8 and 9 for alternate contact with the fixed contacts 8 and 9 in response to being depressed by a plunger 40 and released therefrom. Each of the movable contact tips 6 and 7 is attached onto the snap action spring 5 by being staked or welded thereto. In the miniature switch of the above structure, however, the snap action spring comprises a spring sheet of extremely small thickness, for example, 0.05 mm which makes it difficult to weld or stake the tip on the spring sheet. Further, the tip even successfully welded or staked is of bulky configuration which is larger dimensions in physical size than required for this type of the miniature switch with respect to its current passing capacity, such tip adding considerably to the thickness of the spring sheet with the tip, thus requiring an increased distance between the fixed contacts and therefore the increased height of the contact assembly, thereby resulting in an undesirably increased height of the miniature switch, which opposes the miniaturization of the switch. In addition to the above problem, there arises another problem that the snap action spring is liable to deform or adversely change its spring characteristics when subjected to heat or pressure due the welding or staking operation, which is undesirable for the miniature switch of precision character and is therefore should be eliminated for the purpose of providing a reliable miniature switch over a longer operating life.

SUMMARY OF THE INVENTION

The present invention has been accomplished in view of the above problems and has its primary object of providing an improved miniature switch having a unique movable spring structure which allows the switch to be assembled into a low-profile pack as well to have an extended service life. In accordance with the present invention, the miniature switch comprises a base mounting thereon a common contact member and at least one contact carrier. A movable spring sheet is pivotally supported at its one end to said common contact member so as to snap over for movement of the other free end portion into and out of contact with the fixed contact. The characterizing feature of the present invention resides in that the movable spring sheet is plated with precious metal of good electric conductivity such as silver, gold, or an alloy of each at its portion pivoted to the common contact member as well as at its free end portion for contact with said fixed contact. With this result, the plating on the free end portion of the spring sheet serves as a movable contact of greatly reduced thickness while establishing satisfactory electric connection with the cooperative fixed contact on the contact carrier, in addition to that the plating on the portion of the movable spring sheet pivotally supported to the common contact member ensures good electrical connection therebetween. Thus, the overall thickness of the spring sheet including the plated movable contact can be greatly reduced unlike the spring sheet employed in the prior switch to have contact tips welded or staked thereon, whereby making it possible to reduce the height dimension of the contact assembly and therefore the entire height dimension of the switch. Further, the plating on the spring sheet can be done without substantially deforming or changing the spring characteristics of the spring sheet so as to assure precision contact action and extended operating life.

It is therefore a primary object of the present invention to provide a miniature switch which is made compact particularly to the height and is reliable over an extended period, yet assuring satisfactory electric connection between the associated parts.

In a preferred embodiment, the movable spring sheet is made from a stainless spring steel the substantially entire surface of which is processed with the like plating. It is known that the stainless spring steel is more resistive against repeated loads but has less electric conductivity than beryllium-copper from which most of the prior snap action spring is made. The plating on the stainless spring steel can compensate for the insufficient conductivity inherent to the stainless spring steel such that the plated stainless spring steel can combine good electric conductivity with superior durability, thus assuring a longer operating life than is expected with the prior switch relying upon the snap action spring made of beryllium-copper alloy or the like material. In fact, the plated spring of stainless steel is found to operate over 300,000 cycles of switching actions which is ten times as longer as the normal life expectancy of 30,000 cycles for the spring of beryllium-copper alloy.

It is therefore another object of the present invention to provide a miniature switch which has superior durability for more extended operating life.

Said fixed contact is preferably formed by plating a portion of the contact carrier with the like precious metal. Thus, any other contact tip of bulky configuration can be eliminated from the contact system to thereby further reduce the height dimension thereof and therefore the thickness of the entire miniature switch.

It is therefore a further object of the present invention to provide a miniature switch in which the fixed contact is formed to have a minimum thickness, contributing to attaining the compact arrangement of the miniature switch.

Also mounted on the base of the present miniature switch is another contact carrier with a second fixed contact which is disposed on the opposite side of the movable spring sheet from said fixed contact such that said movable spring is movable between said fixed contact and the second fixed contact for alternative contact therewith. The movable spring is plated with the like precious metal at a portion for contact with each of the fixed contacts so as to have a plated movable contact of greatly reduced thickness on the either side thereof. Said second fixed contact is offset from said fixed contact along the length of the movable spring sheet in order that the movable spring sheet is engaged with the two fixed contact at separate points spaced along the length thereof during the repeated switching actions, thus mitigating the stress concentration in the spring sheet so as to elongate the operating life thereof, which is therefore a still further object of the present invention.

These and other objects and advantageous features will be more apparent from the following description of the preferred embodiment of the present invention when taken in conjunction with the accompanying drawings.

DETAILED DESCRIPTION OF THE PREFERRED EMBODIMENT

Figure 1:
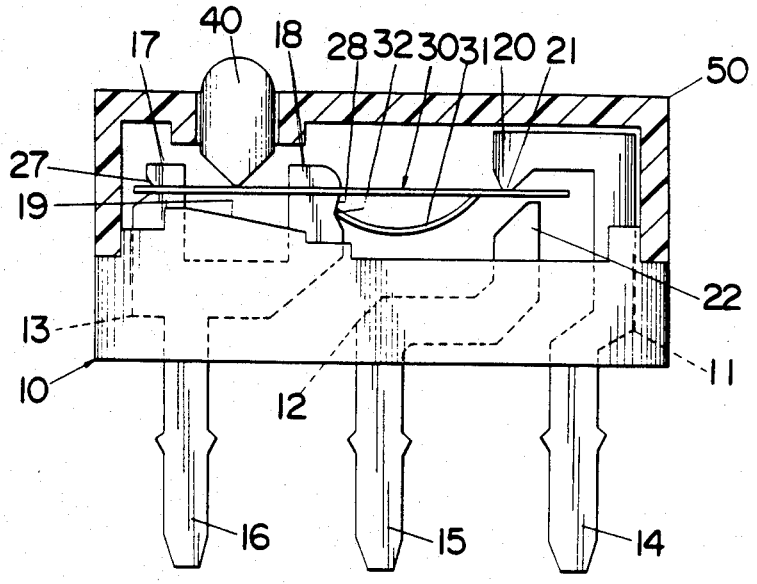
FIG. 1 is an elevational view partly in section of a miniature switch in accordance with a preferred embodiment of the present invention.
Figure 2:
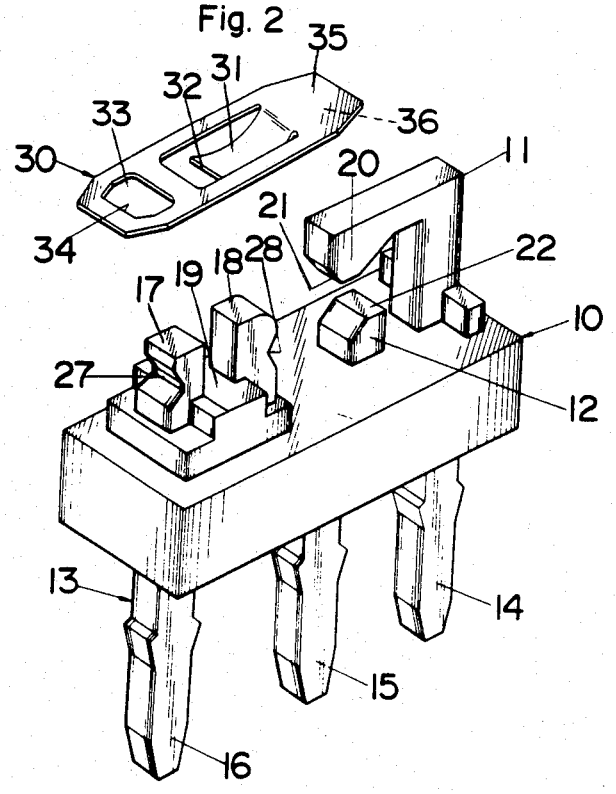
FIG. 2 is an exploded perspective view of the above switch with the casing thereof being removed.

Referring to FIGS. 1 and 2, a miniature switch embodying the present invention comprises a base 10 of insulative plastic material on which are mounted a first contact carrier 11, a second contact carrier 12, and a common contact member 13. A movable snap action spring sheet 30 is pivotally supported to the common contact member 13 for movement with a snap action between two operative positions. The movable spring sheet 30 is biased to one position where the free end portion thereof is in contacting engagement with a first fixed contact 21 on said first contact carrier 11 and is operable to snap over by depression of a plunger 40 to the other position where the same is in contacting engagement with a second fixed contact 22 on the second contact carrier 12, said plunger 40 being slidably received in a casing 50 secured to the base 10.

The above contact elements 11, 12, and 13 are integrally molded with the base 10 and have legs extending downwardly therethrough to define thereat respective terminal lugs 14, 15, and 16 for connection with an external circuit. These contact elements 11, 12, and 13 are punched out from a continuous strip (not shown) of nickle-silver of uniform thickness of about 0.6 mm but remain attached by way of connections at the lower extremities of the respective terminal lugs to the continuous strip until they are integrally molded with the base 10, and are sheared from the continuous strip at the connections so as to be separated from each other after the molding.

Said common contact member 13 is bifurcated at its upper end to define spaced contact supports 17 and 18 by means of which said movable spring sheet 30 is pivotally supported. Said first contact carrier 11 has the upper portion on the base 10 bent into a generally L-shaped configuration with a downward extension 20 which is located above the upper end of the second contact carrier 12 to define therebetween a contact gap into which the free end portion of the movable spring sheet 30 extends for alternative contact with the first and second fixed contacts 21 and 22 defined respectively at the lower end of said downward projection 20 and the upper end of the second contact carrier 12. These first and second fixed contacts 21 and 22 are spaced by a vertical distance or gap distance of about 0.2 to 0.25 mm, which minute distance is far smaller than the thickness (0.6 mm) of said continuous strip from which the first and second contact carriers 11 and 12 are punched out and therefore would be difficult to be obtained if the first and second fixed contacts 21 and 22 were vertically aligned. To this end, they are further spaced horizontally to elongate the effective distance or slit width upto about 0.4 mm therebetween for easy slit forming process with the above punching method, while maintaining the vertical gap distance at the required minute value of about 0.2 to 0.25 mm.

Said first and second contact carriers 11 and 12 have their upper portions above the base 10 plated with precious metal, such as silver, gold, or an alloy of each. It is this plating that defines said first and second fixed contacts 21 and 22. Said downward extension 20 of the first contact carrier 11 and the upper end portion of the second contact carrier 12 include respectively beveled edges adjacent the fixed contacts 21 and 22, which beveled edges are responsible for reducing the flat surfaces of the fixed contacts 21 and 22 and causing the plating material to concentrate on the angled portions including the fixed contacts 21 and 22 during a normal plating operation, thus providing the plating thereon in a thickness greater than the other portions which will not engage with the movable spring sheet 30. In fact, such fixed contacts 21 and 22 can have an increased plating thickness of about 3 to 6 $\mu$ while the other portion is plated in a thickness of about 2 $\mu$ with an ordinary technique of plating the both portions simultaneously, which is economical from a view point of reducing the consumption of precious metal at the portions other than the fixed contacts.

Said movable spring sheet 30 is an elongated one-piece spring preferably formed from a 0.05 mm thick hardened stainless spring material such as SUS 631 precipitation hardening stainless steel (cf. SUS 631 is a grade index of steel material according to the Japanese classification) and includes an integral arcuate compression segment 31 which extends inwardly from the free end portion thereof and terminates at a knife edge 32 intermediate the longitudinal ends thereof. Formed in the pivoted end of the movable spring sheet 30 is a generally rectangular opening 33 with a like knife edge 34 at one of peripheral sides.

The movable spring sheet 30 is plated with the like precious metal as above at least at the portions which are responsible for mechanical and electrical connection with the cooperative contact members, that is, at the portions facing the first and second fixed contacts 21 and 22 as well as at the knife edges 32 and 34 to be hinged to the common contact member 13 for the purpose of ensuring electrical connection at the respective interfaces. It is this plating on both side of the free end portion of the spring sheet 30 that defines respectively first and second movable contacts 35 and 36 of extremely reduced thickness for contact with the cooperative fixed contacts 21 and 22. In the present embodiment, the movable spring sheet 30 of stainless spring steel has its entire surface including said knife edges 32 and 34 plated with the precious metal plating material for the purpose of, in addition to forming the first and second movable contacts 35 and 36 of extremely reduced thickness, compensating low electric conductivity of as less as 2 m/Ωmm$^2$ inherent to such stainless spring steel employed so as to provide required electrical conduction from the common contact member 13 to the fixed contacts 21 and 22 through the plating on the movable spring sheet 30. With this plating on the stainless spring steel, the movable spring sheet 30 can combine improved electric conductivity with superior mechanical strength or durability inherent to the stainless spring steel, such improved conductivity being increased upto 20 m/Ωmm$^2$ equal to that of beryllium-copper alloy generally employed as a movable spring contactor material and such superior mechanical strength permitting the movable spring sheet 30 to operate over 300,000 cycles of switching actions much higher than could be expected with the movable spring contactor of beryllium-copper. The above plating may be directly on the stainless spring steel or over a suitable primary plating, for example, copper plating, as required. Only 3μ thick plating of the precious metal is found to be enough for the movable spring 30 of the present embodiment from an economical standpoint, however thicker plating may be of course acceptable. It should be understood at this time that although the stainless spring steel when processed its entire surface with the above plating can show superior electrical and mechanical characteristics, any other spring of electrically conductive material including beryllium-copper can be employed provided that the free end portion of the spring and the knife edges are plated for establishing good electrical connection at the respective interfaces. Also, the above contact element may be formed from electrically conductive material other than the nickle-silver.

The movable spring sheet 30 is attached to the said common contact member 13 with the knife edges 32 and 34 engaged in a hinged manner respectively with V-shaped bearing recesses 27 and 28 formed in the outer side faces of the contact supports 17 and 18 so that the movable spring sheet 30 is pivotally supported to the common contact member 13 with its free end portion extending into the gap between the first and second fixed contacts 21 and 22, and at the same time it is electrically connected thereto through the respective hinged portions. Said contact supports 17 and 18 are also processed with the like plating for establishing good electrical connection with the movable spring sheet 30. The movable spring sheet 30 is biased in the direction of pressing the free end portion or the first movable contact 35 against the first fixed contact 21 while leaving the second movable contact 36 spaced away from the second fixed contact 22. In this sense, the first fixed contact 21 acts as normally-closed contact and the second fixed contact 22 as normally-open contact. Said plunger 40 has its lower extremity engageable with the movable spring sheet 30 at the portion midway between the contact supports 17 and 18, and in operation it pushes the left-hand end portion of the spring sheet 30 downwardly beyond the dead center position, thereby causing the right-hand or free end portion of the spring sheet 30 to move downward with a snap action to effect engagement of the second movable contact 36 with the second fixed contact 22 while disengaging the first movable contact 35 from the first fixed contact 21. When the movable spring sheet 30 is released from the plunger 40, the resilient force stored in the compression segment 31 will snap the spring sheet 30 back to the initial position as shown in FIG. 1. An abutment 19 for the plunger 40 is integrally formed with the base 10 to project thereon at the portion between the contact supports 17 and 18. It should be noted at this time that since the first and second fixed contacts 21 and 22 are spaced horizontally or spaced along the length of the movable spring sheet 30, the movable spring sheet 30 has the contacting points, i.e., the first and second movable contacts 35 and 36 correspondingly spaced from each other so that it is prevented from being subjected to stress concentration at one point along the length thereof during the repeated switching actions, thereby increasing the durability of the spring sheet and therefore leading to an extended operating life of the spring.

In the figures, only the one arrangement is disclosed to offset the first fixed or normally-closed contact 21 inwardly from the second fixed or normally-open contact 22, the present invention should not be necessarily limited to the above arrangement and be understood to include an alternative arrangement in which the fixed contacts are arranged in the reverse relation to the above.

Figure 3:
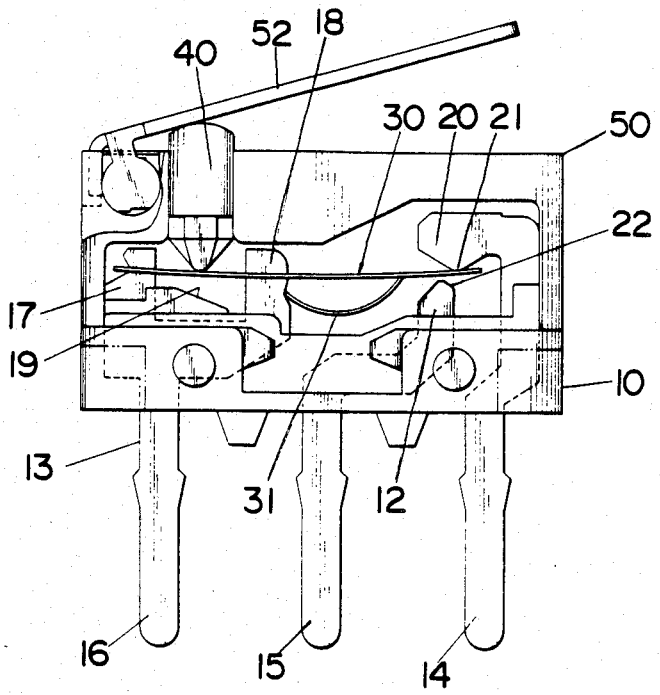
FIG. 3 is an elevational view partly in section of a modification of the above miniature switch.
Figure 4:
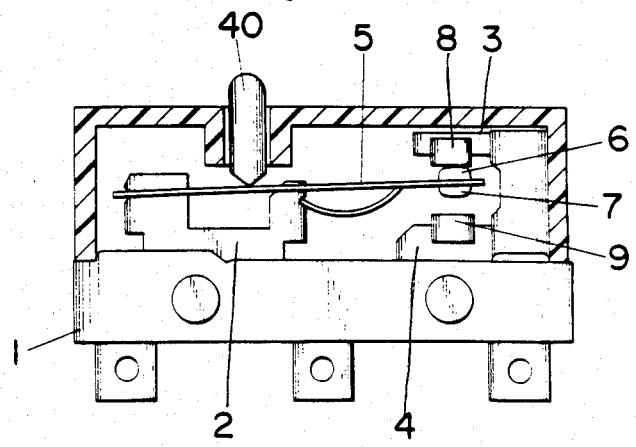
Fig. 4 (PRIOR ART)
FIG. 4 is an elevational view partly in section of a prior miniature switch.

FIG. 3 shows a modification of the above embodiment which is identical to the embodiment of FIGS. 1 and 2 except for an actuator lever 52 which is pivotally mounted to the casing 50 to bear upon the plunger 40 for a particular intended use.

Although the above embodiment discloses the construction in which the first and second fixed contacts 21 and 22 are provided for alternative contact with the movable spring sheet 30, the present invention is not limited to this construction and may be applied to a construction where only one of the first and second fixed contacts is provided depending upon the requirement of an external electric circuit to be switched thereby.

What is claimed is:

1. In a dimensionally compact miniature snap-action switch having a base, a common contact carrier and a pair of fixed contact carriers projecting from said base in spaced relation in a first planar zone defined by said carriers, and a spring sheet supported from and in electrical contact with said common carrier, said spring sheet having a movable flat free end portion of uniform material thickness lying in a second planar zone normal to said first planar zone, the combination of:

a first fixed contact face on one of said fixed contact carriers, said first contact face lying in said second planar zone;

said movable spring sheet end portion having a longitudinal axis, said flat end portion having oppositely directed contact areas and being normally biased into contact with said first contact face in parallel relation thereto;

a second fixed contact face on the other of said fixed contact carriers, said second contact face being spaced in one dimension from said first contact face in said first planar zone and in a second dimension in said first planar zone in the direction of the longitudinal axis of the moveable end portion to position the second contact face opposite a contact area of said moveable sheet end portion longitudinally spaced from said first contact face;

said common and fixed contact carriers having a selected uniform material thickness in said first planar zone;

the spacing of said fixed contact faces in said first planar zone and in said one dimension thereof being smaller than the material thickness of said common and fixed contact carrier;

said sheet end portion having a material thickness smaller than the material thickness of said contact carriers;

said contact areas on said moveable flat sheet end portion and said fixed contact faces being plated with conductive precious metal whereby the space in said first planar zone in said one dimension occupied by said fixed contact faces and contact areas of said moveable end portion is minimized and the height of the switch is reducible;

said first contact face being spaced in said first planar zone and in said second dimension from said second contact face in said longitudinal direction of the axis of said spring sheet moveable end portion to provide a gap greater than the space between said fixed contact faces in said one dimension and said first planar zone to facilitate maintenance of a selected minute space in said first dimension between said first and second contact faces;

each of said fixed contact carriers including a bevelled surface lying in a plane transverse to said first planar zone for collection of plating material while maintaining a selected minimum gap in said one dimension between said fixed contact faces.

2. A switch as claimed in claim 1 wherein said bevelled surfaces are in substantially parallel opposed relation.

* * * * *